United States Patent [19]

Phillips

[11] Patent Number: 4,624,233

[45] Date of Patent: Nov. 25, 1986

[54] FUEL PUMPING APPARATUS

[75] Inventor: Ronald Phillips, Northolt, England

[73] Assignee: Lucas Industries public limited company, Birmingham, England

[21] Appl. No.: 753,374

[22] Filed: Jul. 10, 1985

[30] Foreign Application Priority Data

Jul. 13, 1984 [GB] United Kingdom ..... 8417863

[51] Int. Cl.[4] ..... F09M 39/00

[52] U.S. Cl. ..... 123/506; 123/458; 251/30.01

[58] Field of Search ..... 123/458, 506, 500, 501; 251/30.01, 30.05, 63.4; 417/289

[56] References Cited

U.S. PATENT DOCUMENTS

| | | | |
|---|---|---|---|
| 2,875,780 | 3/1959 | Martin | 251/30.05 |
| 2,905,431 | 9/1959 | Gilbert | 251/30.05 |
| 3,294,120 | 12/1966 | Rochser | 251/63.4 |
| 3,904,167 | 9/1975 | Touch | 251/30.05 |
| 4,333,492 | 6/1982 | West | 251/63.4 |
| 4,418,670 | 12/1983 | Lakin | 123/506 |
| 4,501,406 | 2/1985 | Walther | 251/30.01 |
| 4,546,749 | 10/1985 | Igashira | 123/506 |

FOREIGN PATENT DOCUMENTS

| | | | |
|---|---|---|---|
| 0128428 | 8/1983 | Japan | 123/506 |
| 2009842 | 6/1979 | United Kingdom | 123/506 |

*Primary Examiner*—Carl Stuart Miller

[57] ABSTRACT

A fuel pumping apparatus for supplying fuel to an internal combustion engine has a high pressure pump including a plunger reciprocable in a bore connected to a fuel injection nozzle. Valve means including a valve member and a piston member is provided. The valve member can be moved to a closed position to allow fuel flow to the nozzle and to prevent such flow an electromagnetic valve can be operated to allow displacement of the piston member. Movement of the piston member lowers the pressure of fuel supplied to the nozzle but also moves the valve member to the open position to allow the remaining fuel displaced by the piston to flow to a drain.

6 Claims, 4 Drawing Figures

FUEL PUMPING APPARATUS

This invention relates to a fuel pumping apparatus for supplying fuel to an internal combustion engine and of the kind comprising a pumping plunger reciprocable within a bore, said plunger when inward movement is imparted thereto displacing fuel from a pumping chamber defined in part by the inner end of the bore, an outlet communicating with the pumping chamber said outlet in use being connected to an injection nozzle of the associated engine and valve means operable to allow fuel to escape from said pumping chamber during the inward movement of the plunger thereby to control the amount of fuel which flows through said outlet.

It is known to use an electrically operated valve to control the escape of fuel from the pumping chamber. The design of such a valve presents problems since when open it must provide a sufficiently large flow area to allow a rapid reduction in pressure. This means that the force required to open the valve or to maintain the valve closed depending upon the configuration of the valve, must be large and the force has to be generated by an electrically powered actuator. As a result a substantial amount of electrical power is required to operate the valve and the provision and the control of the power presents difficulties. In addition, the actuator has a substantial size and dissipates a substantial amount of heat.

The object of the invention is to provide a pumping apparatus of the kind specified in a simple and convenient form.

According to the invention in a fuel pumping apparatus of the kind specified said valve means comprises a valve member movable into contact with a seating to prevent escape of fuel from said pumping chamber, said valve member being held in contact with said seating by the pressure of fuel in said pumping chamber while fuel is being supplied through said outlet, resilient means for biasing said valve member away from the seating, a piston member slidable in a cylinder, one end of said cylinder being connected to said pumping chamber, said cylinder having an end wall at said one end thereof, said piston member and said end wall when the piston member is in contact with the end wall defining a closed recess, two way valve means operable to connect said recess to a low pressure source or to said one end of the cylinder, the arrangement being such that during delivery of fuel through said outlet, when said two way valve means is operated to connect said recess to said one end of the cylinder the piston member will move in said cylinder away from said end wall, and means whereby the motion of the piston member will be transmitted to said valve member to lift the valve member from the seating thereby to allow fuel to escape from said pumping chamber.

An example of a fuel pumping apparatus in accordance with the invention will now be described with reference to the accompanying drawings in which.

Figure 1:
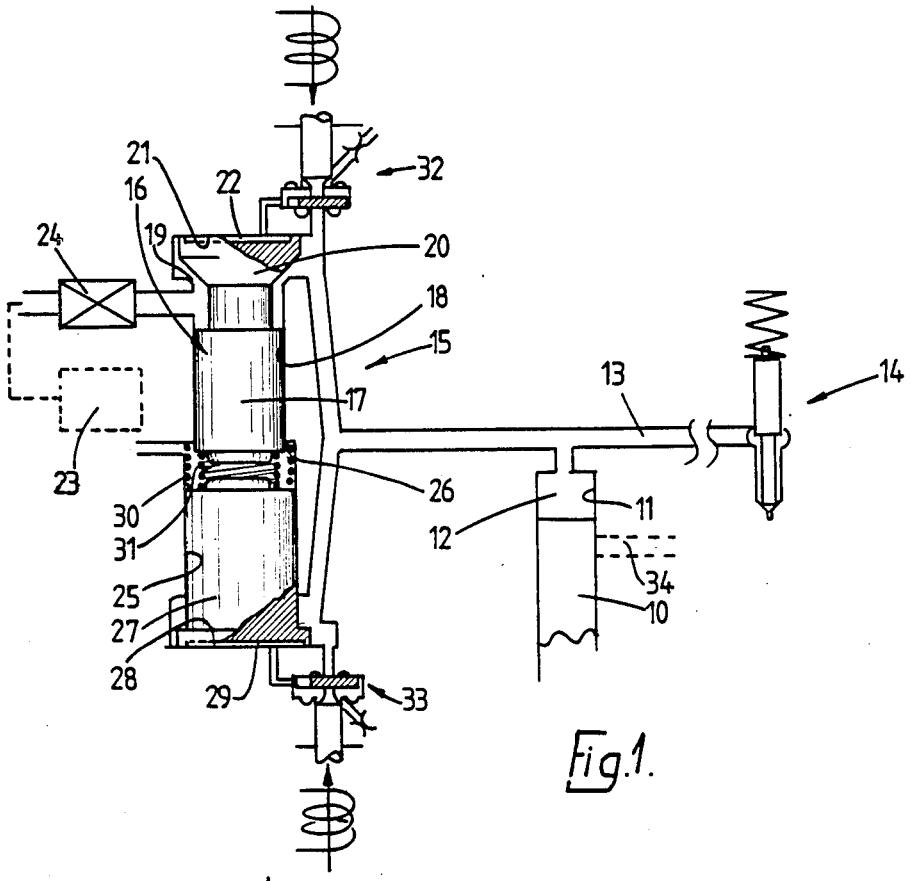
FIG. 1 is a diagrammatic representation of the pumping apparatus.

Referring to the drawings the pumping apparatus comprises a pumping plunger 10 reciprocable within a bore 11 one end of which in conjunction with the pumping plunger, defines a pumping chamber 12. The plunger is movable inwardly in known manner, to reduce the volume of the pumping chamber by means of an engine driven cam and can be moved outwardly by a further cam or by means of a strong spring. The plunger partakes of a fixed stroke. The pumping chamber 12 communicates with an outlet passage 13 which is connected to a fuel injection nozzle 14 of the conventional type which employs a spring loaded valve member movable by the action of fuel under pressure to an open position to allow fuel flow to the associated combustion chamber of the engine. In order to control the amount of fuel which is supplied through the nozzle 14 a valve means generally indicated at 15 is provided and this can be set as will be explained, to allow fuel to escape from the pumping chamber 12 rather than flow to the associated engine through the nozzle.

The valve means 15 includes a valve member 16 having a cylindrical portion 17 slidable within a cylinder 18. At one end of the cylinder there is defined a seating 19 which is engageable by the head 20 of the valve member, the head 20 being of larger diameter than the cylinder 18 and being located in an enlarged chamber defined at the end of the cylinder. The chamber communicates with the pumping chamber 12 and it has an end wall 21. Moreover, the head 20 of the valve member can engage the end wall in the open position as shown, of the valve member and formed in the end of the valve member is a recess 22 which when the head 20 is in contact with the end wall 21, is closed off from the chamber.

Beneath the head 20 the valve member is of smaller diameter than the cylinder 18 and the annular space beneath the head communicates with a source 23 of fuel under pressure, by way of a one way valve/restrictor unit 24. The unit 24 is arranged so that there is substantially no restriction to the flow of fuel from the source 23 into the aforesaid annular space but there is restriction to the flow of fuel in the reverse direction.

Also provided is a further cylinder 25 the longitudinal axis of which coincides with that of the cylinder 18. The cylinder 25 however is of larger diameter and hence there is a step 26 defined at the junction of the two cylinders. Slidable in the cylinder 25 is piston member 27. At its end remote from the cylinder 18, the cylinder 25 is slightly enlarged and communicates with the pumping chamber 12. The piston member 27 has an enlarged end portion which can engage as shown, an end wall 28 of the cylinder 25. As with the valve member 16, the end of the piston member 27 presented to the end wall is provided with a recess 29. The piston member 27 is biased into contact with the end wall 28 by means of a spring 30 which is positioned between the piston member and the step 26. Moreover, a further spring 31 acts between the valve member and the piston member.

The valve means 15 also includes a pair of electromagnetically operable two way valves 32, 33. The valve 32 controls the fluid pressure in the recess 22 while the valve 33 performs a similar function so far as the recess 29 is concerned. In the particular example each two way valve comprises a plate valve member housed within a chamber which is connected to a passage opening onto the respective end wall 21, 28. Each two way valve has a port which is connected to the pumping chamber 12 and the valves are arranged so that when the respective solenoids are energised, the plate valve members will obturate the aforesaid ports. When the plate valve members are obturating the ports, the valve chambers are connected to a drain by way of restricted orifices. When the solenoids are de-energised, the plate valve members can move away from the aforesaid ports to allow as will be explained, the respective recesses to be pressurised with fuel and conveniently the aforesaid drain connections of the valves are closed to prevent loss of fuel.

Figure 2:
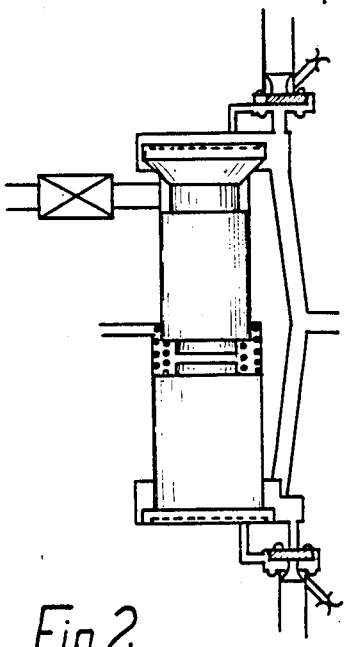
FIGS. 2 and 3 show portions of the apparatus seen in FIG. 1 in alternative positions.

In the position shown in FIG. 1, the valve member 16 is in the open position with the head 20 in engagement with the end wall 21. The solenoid of the valve 32 is energised. Moreover, the piston member 27 is in contact with the end wall 28 and the solenoid of the valve 33 is energised. The recesses 22 and 29 are therefore connected to drain. Assuming now that the pumping plunger 10 starts to move inwardly. Fuel can escape from the pumping chamber 12, the fuel flowing past the valve head 20 and the seating 19 by way of the unit 24 to the source of fuel 23. No flow of fuel therefore will take place to the injection nozzle. The effect of the unit 24 is to pressurise the fuel but the degree of pressurisation is of course substantially less than that required to open the nozzle 14. If now the solenoid of the valve 32 is de-energised, the plate valve member of the valve 32 uncovers the aforesaid port and fuel at the pressure determined by the unit 24, is supplied to the recess 22. The valve member 16 therefore moves under the action of the fuel pressure against the action of the spring 31 so that its head engages the seating. This position is shown in FIG. 2 and once the head has contacted the seating 19 escape of fuel is prevented and the pressure of fuel in the pumping chamber 12 rises to the value at whieh the nozzle 14 opens to permit fuel supply to the engine.

Figure 3:
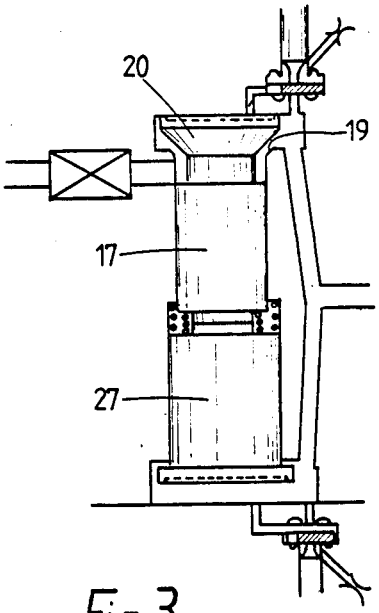

The piston member 27 remains in contact with the end wall 28 but as soon as the solenoid of the valve 33 is de-energised, the fuel pressure in the pumping chamber is applied to the recess 29 and the piston member moves rapidly against the action of its spring 30. In so doing the piston member will absorb some of the fuel flowing from the pumping chamber but during its movement a reduced end portion of the piston member engages a reduced end portion of the valve member 16 and lifts the valve member from its seating. This is shown in FIG. 3 of the drawings and as soon as the valve head 20 is lifted from the seating 19, fuel can escape from the pumping chamber 12 so that the pressure in the pumping chamber falls to a value determined by the unit 24. This pressure is lower than the pressure required to maintain the valve member of the nozzle in the open position and hence the nozzle closes and further supply of fuel to the engine ceases. The valve member 16 is moved by the piston member so that the head 20 engages the end wall 21 and the solenoid associated with the valve 32 can be re-energised to close the aforesaid port and connect the recess 22 to drain. When the inward movement of the pumping plunger 10 ceases and it starts its return stroke, the pressure in the pumping chamber falls further and the combined action of the springs 30 and 31 return the piston member into contact with the end wall. The solenoid associated with the valve 33 is re-energised so that the recess 29 is connected to drain. The fuel displaced by the piston member is returned to the pumping chamber 12 but additional fuel to replace that which has flowed through the nozzle 14, is supplied from the source 23 by way of the unit 24. It may be desirable to provide an additional way in which fuel can flow into the pumping chamber 12 and this can be achieved by providing a port 34 in the wall of the bore 11 and which is uncovered near the outer end of the stroke of the pumping plunger.

The amount of fuel which is absorbed during the movement of the piston member 27 before it effects movement of the valve member is determined by the clearance which exists between the piston member and valve member when the latter is in the closed position.

From the above description it will be appreciated that the valve 32 controls the start of delivery of fuel through the injection nozzle and the valve 33 the end of delivery of fuel. The solenoids of the two valves are energised by means of a control system responsive to various engine operating parameters and since the valves are only controlling the pressures in the aforesaid recesses they can be physically small since the volume of fuel required to pressurise the recesses is very small. Even though they are subjected to the high pressure in the pumping chamber during delivery of fuel, the areas of the plate valve members exposed to these pressures can be very small so that low power solenoids can be used in the construction of the valves.

The springs 30, 31 will be subject to considerable stress and this can be minimised by restricting the flow of liquid out of the space containing the springs. This will have the effect of reducing the rate of movement of the pistons. Another way of overcoming the problem when the apparatus is a distributor type of pump is to remove the springs and to arrange that the space between the valve member and the piston member is connected to the source 23 when it is required to urge the members towards the respective end wall and to a drain at other times.

As described the valve member 16 and the piston member 27 are positioned so that direct physical contact can take place therebetween. In some instances, it may be desirable in order to reduce the volume of the passages connected to the pumping chamber, to position the valve member and piston member in side by side relationship and to connect them by a pivotal lever mechanism which may incorporate lost motion in order to allow movement of the piston member before movement of the valve member. Such an arrangement is seen in FIG. 4 in which identical reference numerals to those used in FIG. 1, are used wherever possible.

Figure 4:
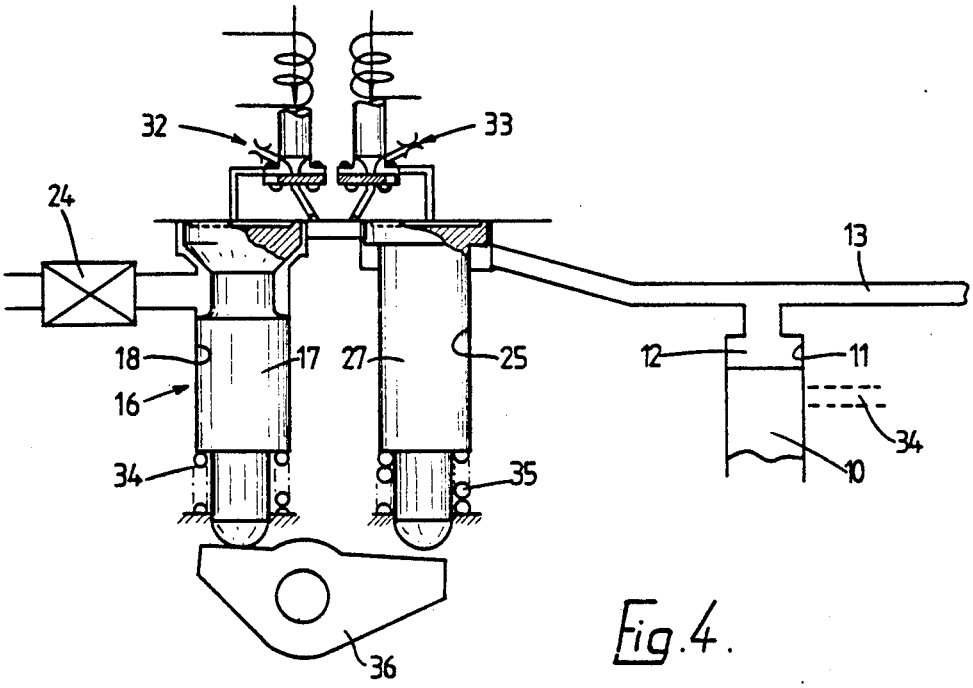
FIG. 4 shows another arrangement of the portion of the apparatus seen in FIGS. 2 and 3.

As will be seen in FIG. 4, the cylinders 18 and 25 are disposed in side by side relationship and the valve member 17 and piston member are biased by springs 34, 35 respectively into contact with the respective end walls. Moreover the reduced end portions of the members are engageable with the opposite ends respectively of a pivotal lever 36. In the example of FIG. 4 the diameters of the members are substantially the same whereas in the example of FIG. 1 the piston member 27 has a slightly larger diameter than the cylindrical portion 17 of the valve member 16. This is in order to ensure that the piston member 27 can move the valve member off its seating. In the example of FIG. 4 the pivot axis 37 of the lever is displaced towards the valve member 16 so that the force exerted by the piston member 17 is enhanced by the lever ratio of the lever.

I claim:

1. A fuel pumping apparatus for supplying fuel to an internal combustion engine comprising a pumping plunger reciprocable within a bore, said plunger when inward movement is imparted thereto displacing fuel from a pumping chamber defined in part by the inner end of the bore, an outlet communicating with the pumping chamber said outlet in use being connected to an injection nozzle of the associated engine and valve means operable to allow fuel to escape from said pumping chamber during the inward movement of the plunger thereby to control the amount of fuel which flows through said outlet, said valve means comprising a valve member movable into contact with a seating to prevent escape of fuel from said pumping chamber, said valve member being held in contact with said seated by the pressure of fuel in said pumping chamber while fuel is being supplied through said outlet, resilient means for biasing said valve member away from the seating, a piston member slidable in a cylinder, one end of said cylinder being connected to said pumping chamber, said cylinder having an end wall at said one end thereof, said piston member and said end wall when the piston member is in contact with the end wall defining a closed recess, two way valve means operable to connect said recess to a low pressure source or to said one end of the cylinder, the arrangement being such that during delivery of fuel through said outlet, when said two way valve means is operated to connect said recess to said one end of the cylinder the piston member will move in said cylinder away from said end wall, means whereby the motion of the piston member will be transmitted to said valve member to lift the valve member from the seating thereby to allow fuel to escape from said pumping chamber, further resilient means biasing the piston member towards said end wall, said valve means including a head engageable with the seating, the head in the open position of the valve engaging an end wall of a cylinder housing the valve member, a recess defined between the head of the valve member and the last said end wall when said valve member is in the open position, and further two way valve means operable to connect said last named recess with the pumping chamber when it is required to close the valve.

2. An apparatus according to claim 1 in which said valve member and said piston are mounted in end to end relationship and mount projections respectively, said projections engaging with each other to transmit the motion of the piston member to the valve member.

3. An apparatus according to claim 2 in which the diameter of said piston member is slightly larger than the seat area of the valve member.

4. An apparatus according to claim 1 in which said valve member and said piston member are located in side by side relationship, the apparatus including a pivotal lever, the ends of the lever being engageable with the members respectively, to transmit the movement of the piston member to the valve member.

5. An apparatus according to claim 4 in which the diameter of the piston member is substantially equal to the seat area of the valve member, the pivot axis of the lever being displaced towards the axis of movement of the valve member.

6. An apparatus according to claim 1 in which the ends of said valve member and piston member remote from said end walls are exposed to a low pressure, the apparatus including means for pressurizing the fuel downstream of the valve during displacement of fuel from the pumping chamber.

* * * * *